United States Patent [19]

Glass et al.

[11] Patent Number: 4,981,068

[45] Date of Patent: Jan. 1, 1991

[54] EXPANSIBLE CHAMBER DEVICE HAVING VARIABLY RESTRAINED VALVE SYSTEMS

[76] Inventors: Thomas R. Glass, 15307 Horborne La., Pflugerville, Tex. 78660; Weldon R. Hudson, 8312 Renton, Austin, Tex. 78758

[21] Appl. No.: 430,338

[22] Filed: Nov. 2, 1989

[51] Int. Cl.[5] ..... F01L 25/08

[52] U.S. Cl. ..... 91/268; 91/275; 91/330; 91/341 R; 91/454

[58] Field of Search ..... 91/268, 275, 330, 341 R, 91/454, 468; 137/460, 498

[56] References Cited

U.S. PATENT DOCUMENTS

| | | | |
|---|---|---|---|
| 694,547 | 3/1902 | Hood | 91/275 |
| 794,882 | 7/1905 | Pagenhart | 91/454 |
| 1,527,678 | 2/1925 | Farquhar | 91/275 |
| 3,313,213 | 4/1967 | Wandel | 91/468 X |
| 3,910,160 | 10/1975 | Divine | 91/273 X |
| 3,924,693 | 12/1975 | Whitehouse | 91/468 X |
| 4,050,357 | 9/1977 | Carter et al. | 91/410 |
| 4,283,995 | 8/1981 | Ackerman | 91/410 |

*Primary Examiner*—Stephen M. Hepperle
*Attorney, Agent, or Firm*—Dodge Bush & Moseley

[57] ABSTRACT

In accordance with an illustrative embodiment of the present invention, an expansible chamber device includes a piston movable within a cylinder, a head on the cylinder having intake and exhaust ports, a normally-open intake valve for closing the intake port automatically when the flow rate or velocity of a working medium entering the cylinder reaches a predetermined value, variable restraining means for inhibiting closing of the intake valve in response to flow, an exhaust valve for preventing escape of working medium from the cylinder until cylinder pressure is reduced to a set level, spring means for opening the exhaust valve at that level, and means operable near the top-dead-center position of the piston for automatically opening the intake valve and for closing the exhaust valve to enable the cycle to repeat. A unique system for controlling the variable restraining means, as well as methods for regulating the flow or working medium through said valves, also is disclosed.

27 Claims, 7 Drawing Sheets

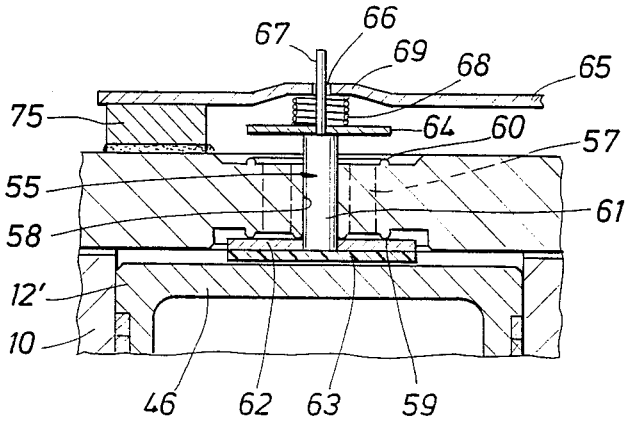
FIG. 3
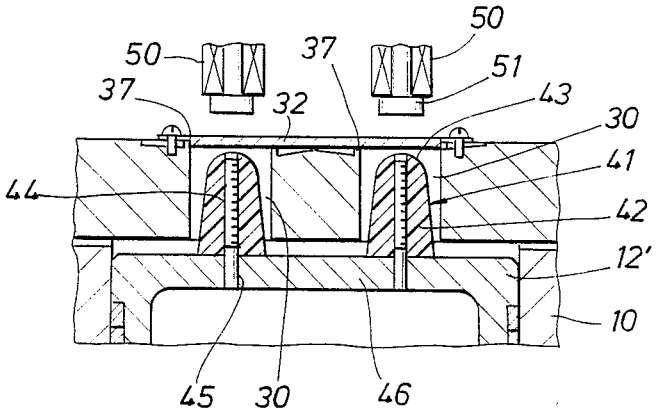
FIG. 4
FIG. 5
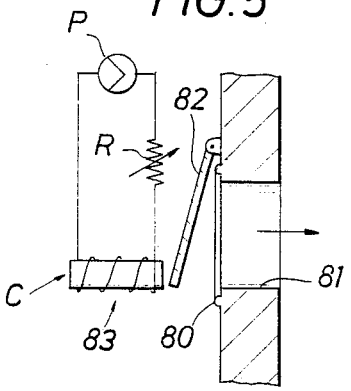
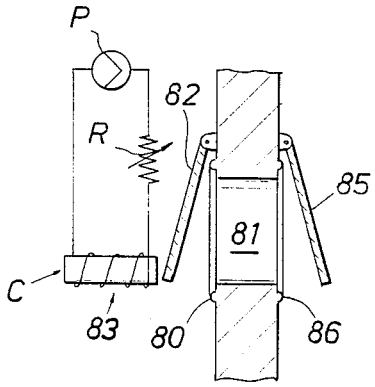
FIG. 6
FIG. 7
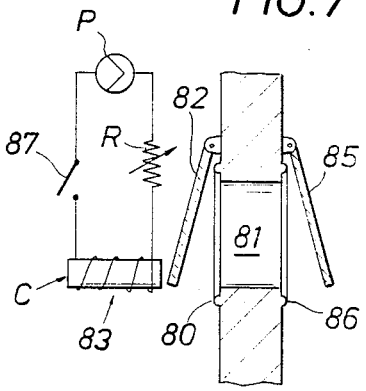
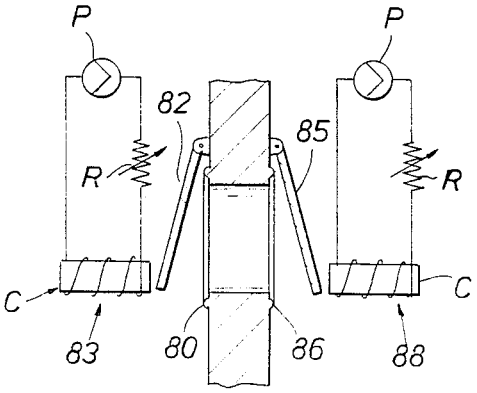
FIG. 8
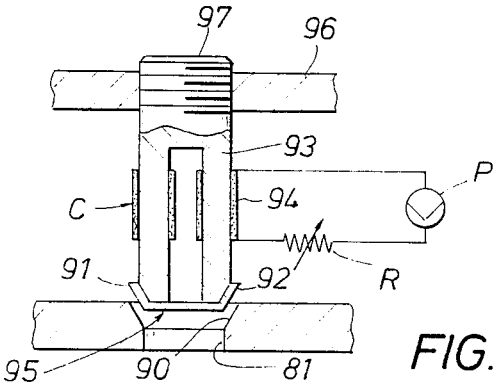
FIG. 9

FIG. 18
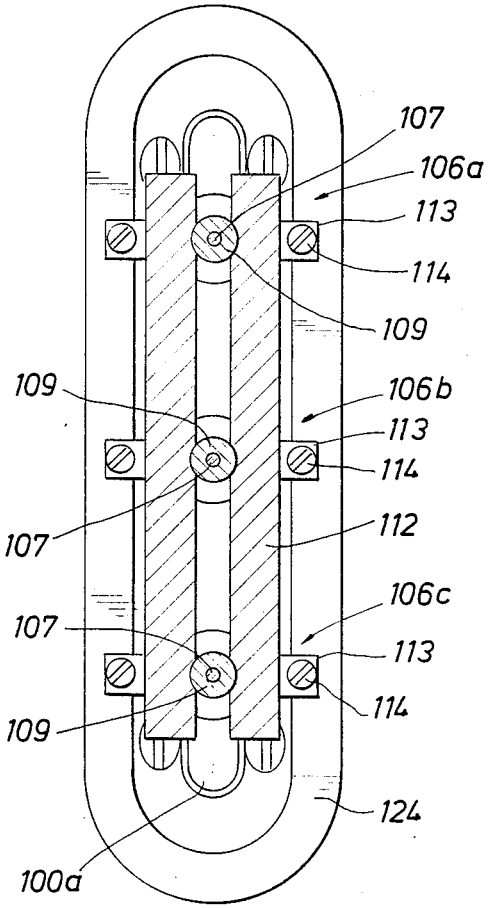
FIG. 19
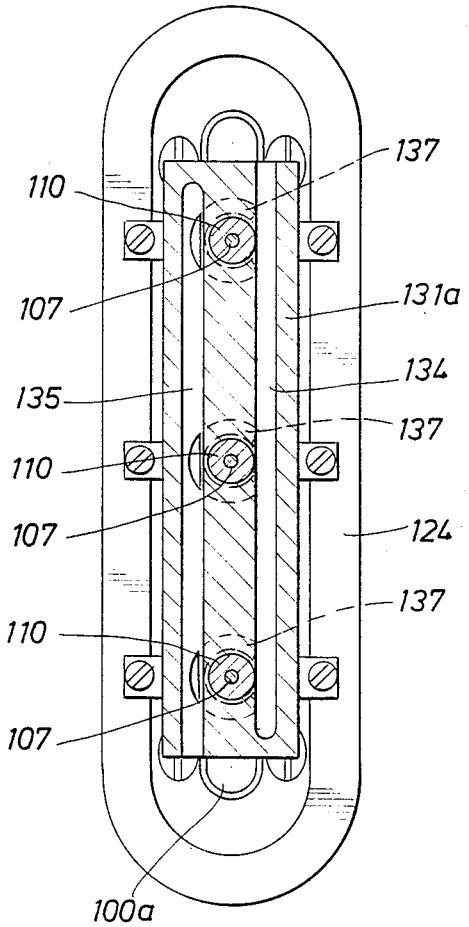
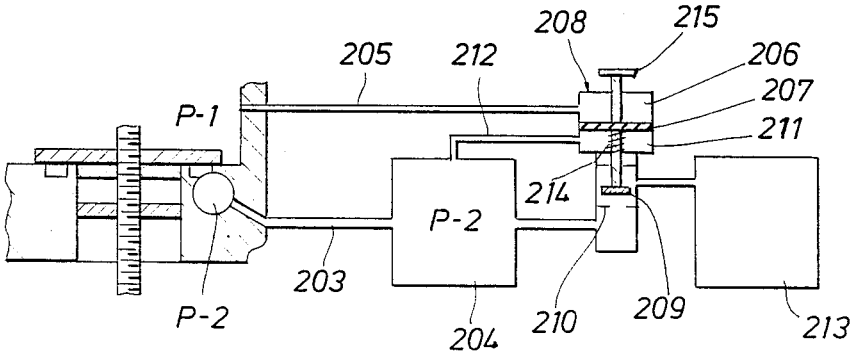
FIG. 20

EXPANSIBLE CHAMBER DEVICE HAVING VARIABLY RESTRAINED VALVE SYSTEMS

FIELD OF THE INVENTION

This invention relates generally to valve systems used in expansible chamber devices, and particularly to a unique valve system that is subject to variable restraining forces that prevent the valve from closing until a characteristic property of the working medium, for example its flow rate or velocity, is exceeded. The invention has particular application to an expansible chamber engine that does not employ camshafts and the like to control actuation of intake and exhaust valves. In this application, the device has an intake valve that is closed in response to the velocity of a working medium flowing into the expansible chamber. The exhaust valve can include linked, upstream and downstream check valve elements arranged to allow exhaust from the expansible chamber under low pressure. Contact with the movable member, such as a piston, causes substantially simultaneous resetting of the intake valve to its open position, and closing of the upstream exhaust valve element. In all embodiments, the restraining force that holds the intake valve open is adjustable to provide variable control over the closing thereof.

BACKGROUND OF THE INVENTION

Most piston operated engines, for example, use chain driven camshafts to control the actuation of spring-loaded intake and exhaust valves. Other engines have used slide valves that are actuated by complex gearing. All such systems are fairly complex, and have high friction losses that reduce engine efficiency. Such systems also wear out rapidly, and thus are expensive to maintain. It therefore would be highly desirable to provide an expansible chamber device having intake and exhaust valves that either are condition responsive, or are actuated by contact with the working member of the engine. In this manner, all mechanical linkages such as camshafts and the like are eliminated to minimize weight, complexity and wear, and to increase engine efficiency.

Various systems have been proposed for eliminating the use of mechanical linkages to control the intake and/or exhaust valve functions in expansible chamber devices. See U.S. Pat. Nos. 1,527,678, 3,910,160, 4,050,357 and 4,283,995. However none of the systems of which applicant is aware provide any means to change or adjust the event of valve closing while the engine is in operation, and some are quite complex and are likely to be unreliable in operation over extended periods of time.

Accordingly, there has been a long felt need for a reliable and efficient valve system for regulating the flow of fluid into and out of the chamber of a cyclically operable expansible chamber device such as an engine, compressor, pump, expander, blender and metering system, to name but a few of the applications in which the present invention is usable. Such valve systems should be constructed and arranged so that there is a flexible relationship between cycle phase and valve operation, particularly since operation naturally produces cycles of fluid pressures and flows that have characteristic properties which can be used to operate valves in an efficient manner. Applicant has recognized that, for example, a series combination of two check valves which are oriented to permit free flow away from each other, can be controllably restrained in the open position so as to perform most, if not all, of the inlet and/or outlet functions required of cyclically operable expansible chamber applications. Such a valve system will not normally open between two zones having significantly different fluid pressures, so that dissipation of fluid energy from such event is avoided. On the other hand the valve system will open when pressures across it are reversed, which will usually happen twice during the typical cycle: once on rising chamber pressure and once on falling chamber pressure. The valve will remain open until the closing forces generated by the flow of working fluid through the upstream valve exceeds the forces that restrain the valve from closing. Applicant has also recognized that the magnitude of the restraining force can be controlled, and can be set or timed to allow any amount of flow of working medium that is desired in a particular application. Such a valve system can therefore be actuated at the most efficient points in the pressure cycle with a minimum of control energy requirement.

A broad object of the present invention is to provide an expansible chamber device having a unique intake valve system that closes in response to a working medium flow characteristic, such as flow velocity, and which is subject to variable restraining forces to provide control over valve closing.

Another object of the present invention is to provide a motor of the type described having an intake valve that is closed automatically in response to a characteristic of intake flow, such as its rate or velocity, said valve being held open by a restraining force that is variable to provide control.

Another object of the present invention is to provide a new and improved motor of the type described having a restrained intake valve that closes automatically in response to the velocity of flow of working fluid, and means for changing or adjusting the restraining force in order to set the particular flow velocity at which the valve can close.

Another object of the present invention is to provide an expansible chamber motor having a new and improved exhaust valve system that automatically opens at low pressure differential between cylinder pressure and ambient pressure, and which is closed in response to direct or indirect impingement of the movable member.

A further object of the present invention is to provide a new and improved process for regulating the flow of a working medium from one chamber to another by providing a variable restraining force that controls the operation of a check valve between the chambers.

SUMMARY OF THE INVENTION

These and other objects are attained in accordance with the concepts of the present invention through the provision of an expansible chamber device having a piston that reciprocates within a cylinder. The device also may include a valve that rotates within a chamber, or a male and female pair of screws that rotate within a chamber. A valve head that defines the outer end of the cylinder or chamber includes an intake valve section and an exhaust valve section. The intake valve section is communicated with a plenum which is supplied with an expansible working medium, and the exhaust valve section is communicated with an exhaust manifold.

The intake valve section of the valve head has an intake port that is surrounded by an outwardly facing valve seat. An intake valve element, for example a hinged disc or equivalent structure, is arranged to close against the seat when a characteristic property of the working medium, for example its flow velocity, exceeds a controlled or predetermined value. After the intake valve closes, and as the piston retreats in the cylinder under the force of the expanding medium, the cylinder pressure decreases with respect to plenum pressure so that the valve is held closed by pressure differential until the piston returns to near top-dead-center (TDC). In a preferred embodiment, a lifter element on the piston extends through the intake port at TDC and forces the valve off its seat and the valve element is captured in the open position by a restraining device, so that another charge of working medium can enter the cylinder.

The intake valve element is subject to variable restraining forces, for example a restraining force due to the magnetic field of a coil mounted adjacent the valve element. The intake valve will remain open until the forces tending to close the valve, which are proportional to the velocity of working medium entering the intake port, exceed restraining forces which are proportioned to the magnitude of electric current through the coil.

The exhaust valve section of the head has an exhaust port that is surrounded by both inwardly and outwardly facing valve seats. A linked check valve system controls flow of exhaust through this port, and includes an outwardly closing check valve element that is biased inward by a spring. This check valve is forced closed against its seat by contact with the piston as it nears TDC, and is held closed by cylinder pressure as a new charge of high pressure working medium comes in through the intake port. When the piston retreats to near BDC, cylinder pressure is reduced to a value that will permit the spring to open the check valve to enable spent working medium to flow to the exhaust manifold as the piston returns toward TDC. If desired, an outwardly opening check valve can be provided which readily permits outward flow but prevents inward flow. Upon closing of the exhaust valve, and the substantially simultaneous opening of the intake valve, the cycle repeats.

In accordance with another feature of the present invention, a remotely controllable means is provided to vary the restraining force on the intake valve element. In this manner, the amount of working medium that enters the cylinder prior to valve closure can be increased or decreased to control piston speed and power output. Where an electromagnetic element such as a coil is used for this purpose, a means such as a power supply and adjustable rheostat can be used to change the amount of current flow through the coil, and hence the strength of the magnetic field. The current control mechanism can be operated manually or automatically in response to a sensed condition such as temperature and/or pressure, or other variable in the system.

In accordance with a method aspect of the present invention, flow of fluid from one chamber to another chamber is regulated by controlling a check valve located between such chambers. Such regulation is accomplished by permitting flow from the normal outlet of the check valve to its normal inlet, from a point in the cycle where chamber pressures are substantially equal, by restraining the closing of the check valve, and then, after determining that sufficient flow has occurred for one cycle, releasing the check valve to close normally. The releasing step can be carried out in various ways, for example by adjusting one of the parameters affecting fluid flow force tending to close the check valve such that the force exceeds the restraining force when the instantaneous flow rate at which closure is desired is reached, or by reducing the restraining force to a value that is less than the fluid flow force when the instantaneous flow rate at which closure is desired is reached. The check valve then is opened automatically when system pressures reverse, or the valve can be opened by direct or indirect action of a movable wall of the chamber as the chamber volume approaches a minimum value. Once open, the check valve is again restrained in its open position as the cycle restarts.

A method in accordance with the present invention can also be practiced using a series-combination of two oppositely directed check valves in a passage that leads between two chambers having cyclically reversing relative pressures by restraining the closure of one check valve that is opposed to flow in that direction, beginning at a point in the cycle where the chamber pressures are substantially equal. Then when sufficient flow in such direction has occurred for that cycle, the said one check is released to close as it normally would. The decision on when to permit the check valve to close can be based upon one of several relationships, such as instantaneous flow rate to mass of fluid passed, time elapsed to mass of fluid passed, chamber size to mass of fluid passed, or by any result or determination of instantaneous flow rate to any other sensed parameter. Actual closure of said one check valve can be accomplished as set forth above. Thus upon reversal of relative chamber pressures, flow is permitted in the reverse direction through the passage by restraining the closure of the second check valve until closure is desired, as determined in the manner above-stated, whereupon the first check valve is opened, as indicated, and the cycle restarts.

As required by various applications, the restraining force can be constant after initial selection, adjustable over a series of cycles, or adjustable in syncronism with the cycle. The potential application of the second and third types of restraining force adjustment is best illustrated if the factors affecting the fluid force tending to close the valve (such as cycle frequency, working fluid viscosity and density, and valve geometry), are held constant while the restraining force is varied. If the restraining force is varied slowly with respect to cycle frequency, the phase at which cutoff will occur can only be adjusted within the range of positive $dV/dt$. If the restraining force is varied (or switched) in syncronism with the cycle, the phase at which cutoff will occur can be varied through the full chamber volume cycle.

One application of the first-mentioned type of restraining force adjustment (or selection) in an engine is best illustrated if the restraining force is held constant while the factors affecting the fluid force tending to close the valve is allowed to vary. In one particular case, if the inlet pressure (and thus density as well) rises, the increased density of the fluid tends to close the valve at an earlier phase, which tends to counter the increase in fluid power that would otherwise have resulted from the increased fluid pressure. In a second case, any decrease in speed of the machine will tend to reduce the fluid velocity through the valve, which delays the closure of the valve, which increases the fluid energy admitted, which tends to counter the speed reduction. In these two cases, it is apparent that a constant restraining force is a relatively stable control strategy, and may be suitable for applications not requiring close speed or power regulation. By comparison, this inherent stability is also a characteristic of systems using the second type of restraining force adjustment.

One means of controlling the restraining force in syncronism with the machine cycle is known. This method involved linkages indirectly connected to the working member, and had no provision for adjustment while the machine is running. The holding force is released at the same phase angle every cycle for any given trigger setting. The present invention can be equipped with any of several types of phase angle controls, or any of several types of time delay controls. For equipment applied at constant speeds, such as those connected through alternators or motors to constant frequency utility grids, time and phase angle are proportional to each other, and are thus interchangeable as control variables.

A time delay mechanism is triggered by a trip device, such as a switch, such that the restraining force is high for a controllable time period after the chamber passes through minimum volume and drops to a low value for the remainder of the cycle. Electronic and pneumatic time delay devices are easily designed for operation of electromagnets and pneumatic restraining devices. Triggering devices are easily connected to or derived from either intake or exhaust valves, direct contact with the working member, or fixed keys or cams on machine shafts.

The holding force may be controlled by phase angle in several ways. The known prior art used mechanical linkages, which are subject to wear, inaccuracy, and control difficulty. However, automatic control can be applied to such mechanisms. In the preferred embodiment, phase angle triggering is accomplished by monitoring the phase angle of the machine (or some function thereof such as one of the chamber dimensions) and comparing that reading to a desired trip value. If both the reading and the desired value are expressed as electrical currents or voltages, comparison is both fast and simple. The triggering point is adjusted by adjusting the desired trip value, which need not involve any connection to moving parts.

BRIEF DESCRIPTION OF THE DRAWINGS

The present invention has other objects, features and advantages that will become more clearly apparent in connection with the following detailed description of preferred embodiments, taken in conjunction with the appended drawings, in which:

FIG. 3 is a cross-section on line 3—3 of FIG. 2 showing closure of an exhaust valve assembly by a piston;

FIG. 4 is a cross-section on line 4—4 of FIG. 2 showing impending opening of an intake valve by lifters on a piston;

FIGS. 5–9 are schematic representations of various valve systems in accordance with the present invention;

FIG. 18 is a section on line 18—18 of FIG. 10;

FIG. 19 is a section on line 19—19 of FIG. 11; and

FIG. 20 is a schematic view of a pneumatic controller or restraining means in accordance with the present invention.

DETAILED DESCRIPTION OF PREFERRED EMBODIMENTS

Figure 1A:
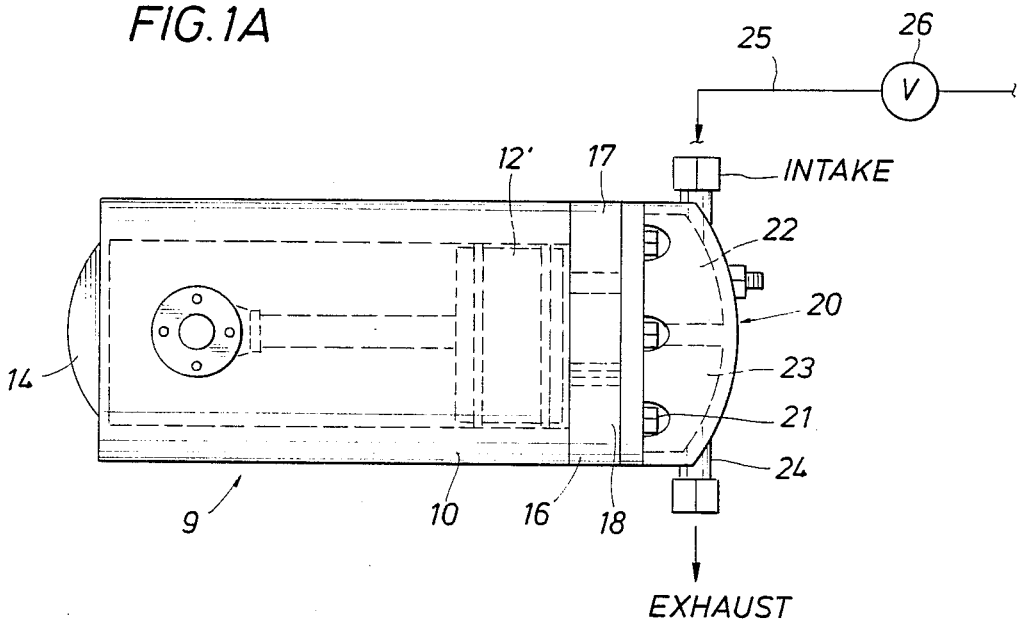
FIGS. 1A and 1 B are respective side and top views of the major components of an engine that employs the present invention, including block, head, and intake and exhaust manifold.
Figure 1B:
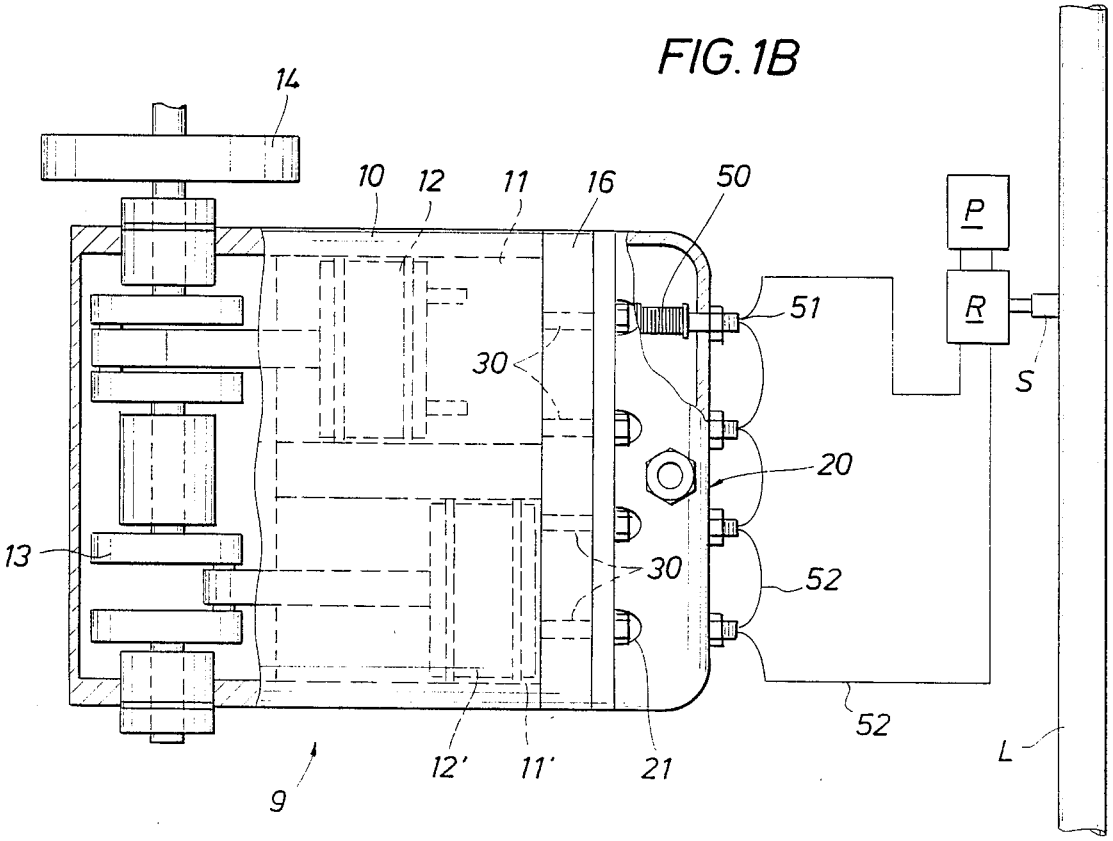

Referring initially to FIGS. 1A and 1B, an expansible chamber engine 9 is illustrated as an example of a cyclically operable device to which the present invention has application. Of course the invention is not limited to engines, and can have numerous other applications as will become apparent to those skilled in the art. The engine 9 includes a block 10 having cylinders 11 and 11' in which pistons 12 and 12' are reciprocable. In the usual manner the pistons are connected to a crankshaft 13 by wrist pins and rods (shown in phantom lines) to convert reciprocating movement of the pistons to rotation of the output shaft. A flywheel 14 typically is mounted on the outer end of the crankshaft 13.

A valve head 16 is adapted to be bolted onto the block 10 and sealed with respect thereto by a gasket. The head 16 has a higher pressure intake valve section 17 and an exhaust valve section 18. A manifold 20 is arranged to fit onto the head 16, and a plurality of studs 21 are employed to secure the manifold and the head 16 to the block 10. The manifold 20 has separate higher and lower pressure chambers 22, 23, with the higher pressure chamber 22 being a plenum that receives a pressurized, expansible, working medium such as steam, air or the like. The medium can be piped to the plenum via a line 25 having a valve 26. The exhaust chamber 23 has an outlet 24.

Figure 2:
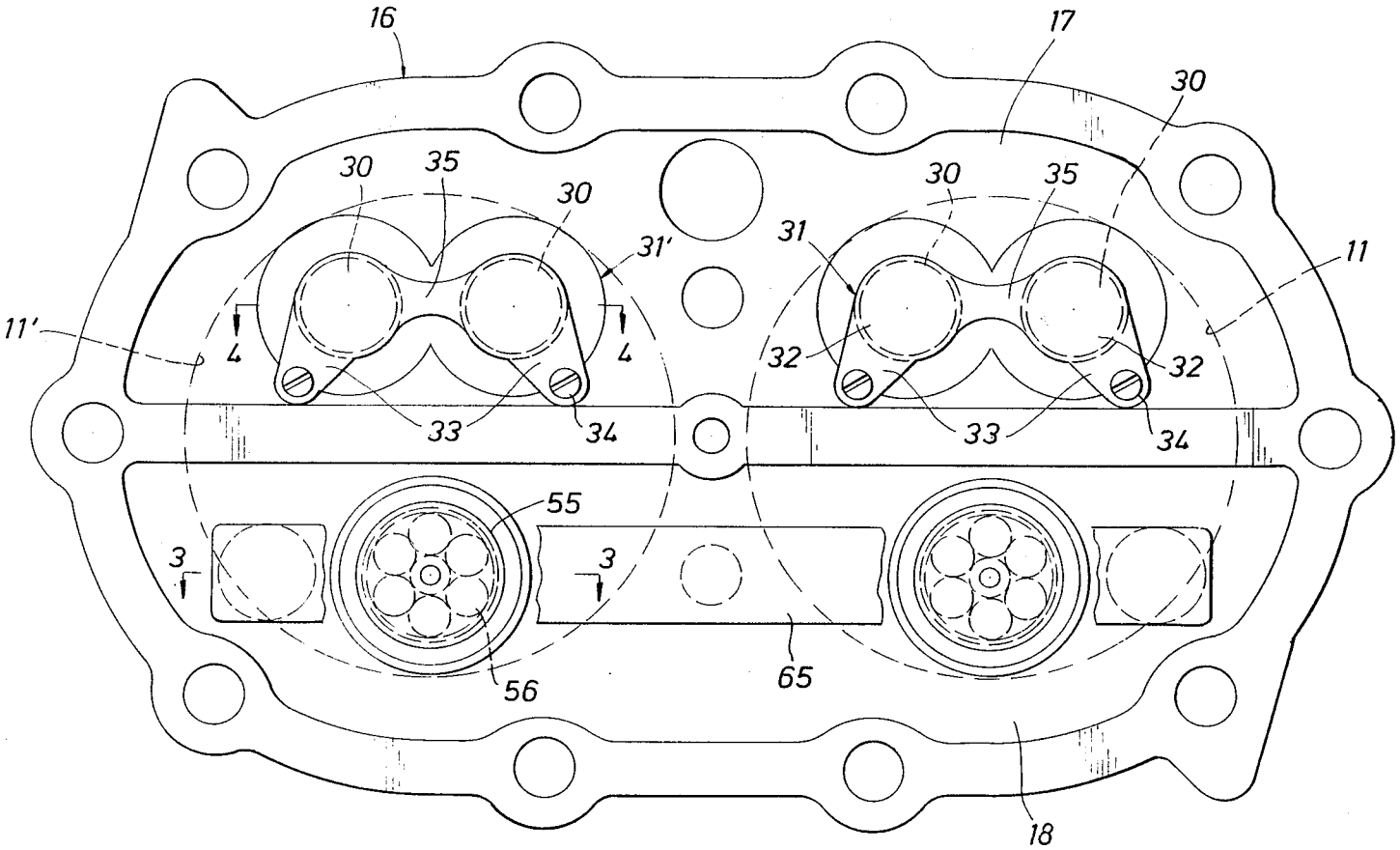
FIG. 2 is an outside frontal view of the head or valve block of FIG. 1.

With reference to FIG. 2, each of the cylinders 11 and 11' is provided with a pair of intake ports 30 formed in the valve section 17 of the head 16. Although two intake ports 30 are shown, a single port could be used. Intake valve elements 31 and 31' are mounted adjacent the respective intake ports 30, and in the form shown comprise thin metal plates 32 having legs 33 that are attached to the head 16 by screws 34. Alternatively, the elements could be hinged plates, or floating plates that are guided in a suitable manner with respect to the intake ports 30. In the embodiment shown, the plates 32 are joined by a web 35. In the preferred embodiment, the valve elements 31 and 31' are slightly biased against the intake ports 30. This closing bias is subordinate to the lifting force of the element 41 and the restraining force of the magnets 50 and 51. Thus o arranged, the valve elements 31 and 31' respond to opening force from the lifting elements on the piston and to retention force from the restraining mechanism. Once a plate 32 is closed against the seat 37 as shown in FIG. 4, however, an excess of plenum pressure with respect to cylinder pressure will apply inward force to hold the plate on the seat and prevent further in-flow of working medium. The intake valve elements 31, being formed as thin metal plates, have very low mass so as to be quick opening and closing.

As shown in FIG. 4, the outer faces 46 of the pistons 12 and 12' are each provided with a pair of valve lifter elements 41. Due to rotational orientation of the pistons within the cylinders, the lifter elements 41 are axially aligned to enter the intake ports 30 each time the pistons come to top-dead-center. In the embodiment illustrated, each lifter 41 comprises a conical element 42 having a rounded upper surface 43. Each element 42 can be threaded onto a stud 44 that is fixed in an aperture 45 in the top section 46 of the piston. The outer end surface of the stud 44 preferably is located somewhat below the upper surface 43. If desired, suitable seals can be mounted in a manner to prevent leakage of high pressure working medium past the studs 44. The valve lifters 41 can take other forms, however it is considered to be desirable that each lifter substantially fill the intake port volume at TDC so that there is minimal clearance, and thus minimal flow, at the instant the intake valve is opened.

The lifter elements 42 are of a length such that slightly prior to the time that the pistons 12 or 12' reach top-dead-center, the upper surface 43 will bump the intake valve elements 32 and force them to open against the differential in pressure between plenum pressure and cylinder pressure. With very little volume in the cylinder and valve area, the flow of working fluid is momentary at the time the lifter element opens the valve element. After this momentary surge of fluid, the valve element is captured by the magnetic field of the restraining mechanism. With a valve element 32 open, a charge of working medium will enter the cylinder and apply inward force to a piston. As the piston 12', for example, begins to retreat, working medium will continue to enter the cylinder 11' through the intake ports 30 until the flow rate through the intake ports exceeds a controlled value, at which time the flow will cause the valve element 32 to move into closed position against the seat 37. As the piston 12' retreats further and the cylinder volume increases, the pressure of the working medium within the cylinder decreases so that the differential pressure holding the valve element 32 closed increases. Thus the intake valve element 32 will remain closed throughout the expansion phase of the cycle.

In order to control the closing of the intake valves 32, a variable restraining system is provided. As shown in FIGS. 1B and 4, such control system can take the form of a plurality of electromagnets consisting of coils 50 and studs 51 forming cores of the magnets, which are arranged to include the valve elements 31 and 31' in the magnetic circuit, especially when the valve elements are away from the ports 30 and 30'. The coils 50 may be within the manifold as shown, or externally mounted with the magnetic material passing through the manifold wall. The studs 51 can be arranged in a line on the manifold 20 in a manner such that there is one coil adjacent each intake valve element 32. The coils 50 can be hooked up in series or individually by suitable conductor wires 52, and connected thereby to a suitable source of variable electric current controlled in response to system variables such as speed, temperature and/or pressure. In this manner, the magnitude of the restraining forces can be automatically controlled. Of course the restraining forces can be manually controlled by hand adjustment of the variable current source R. The magnetic field set up around each coil 50 is a function of the number of coil turns and the magnitude of the current. The magnetic fields that are created attract the valve elements 32 toward the coils 50 and thereby provide restraining forces tending to prevent closing movement of the valve elements. Where the valve elements 32 take the form of hinged or floating discs, the magnetic field provides the sole restaining force. In this manner the cut-off points of the intake valves 31 and 31' can be selectively increased or decreased, depending upon the value of the current applied to the coils 50.

Each of the cylinders 11 and 11' is provided with an exhaust valve assembly 55 that controls flow of working medium out an exhaust port means 56 which communicates with the lower pressure region of the manifold 20. As shown in FIG. 3, each port means 56 can have a plurality of angularly spaced individual passages 57 that are located radially outward of a central opening 58. Raised lips 59, 60 surround the passages to provide inner and outer valve seats, respectively. Each valve assembly 55 includes a stem 61 that extends slidably through the opening 58, and a valve disc 62 that is fixed to the inner end of the stem. A cushion in the form of a circular elastomer pad 63 is adhered to the outer face of the disc 62. Alternatively, magnetic repulsion may be used in place of the elastomer pad.

The outer end of the stem 61 also is provided with a disc 64 that is fixed thereto. A keeper bar 65 extends across both exhaust valve assemblies 55 as shown in FIG. 2, and has apertures 66 that receives guide pins 67 that project from the upper ends of the stems 61. Coil springs 68 react between upraised portions 69 of the bar 65 and the upper faces of the discs 64. The springs 68 yieldably urge the inner discs 62 away from the seats 59, and the outer discs 64 toward the seats 60. The valve disc and stem arrangement shown can be considered to be a linked check valve system. When the inner disc 62 is against its seat 59, working medium can not enter the exhaust passages 57 so long as there is a sufficient excess of cylinder pressure over ambient or manifold pressure. The pressure differential provides axial force that is greater than the bias force of the spring 68 in order to keep the element 62 closed. However, when the piston 12' approaches bottom-dead-center, the pressure in the cylinder 11' will have decreased to a value that enables the spring 68 to force the disc 62 off the seat 59. A relief port could be opened when the chamber approaches maximum volume to insure that the chamber pressure drops to the lower pressure. Then as the piston 12 returns outward, spent working medium can exhaust into the manifold 20 via the passages 57, pushing the outer disc 64 off its seat 60 since the disc 64 will not hold pressure in the outward direction. The exhaust valve assembly 55 is arranged such that the upper disc 64 is slightly biased toward its seat when it is between its seated and its mid-travel positions, and is strongly, but yieldably, retained against further opening by the permanent magnet 75 that anchors keeper bar 65. When the piston 12' contacts cushion pad 63, the keeper bar 65 is forced away from the permanent magnet 75, allowing disc 63 to close against seat 59.

As the piston 12' reaches top-dead-center, its outer face engages the cushion pad 63 and forces the lower disc 62 to close against the seat 59. The dimension of the cushion on the valve element 62 is such that the piston contacts this cushion a few degrees of crank shaft rotation before the element 42 lifts the valve element 32. Consequently, the valve port 57 is sealed as or before valve element 32 is opened. Since at approximately the same piston position the intake valve 32 will have been opened as previously described, the intake of working medium quickly pressurizes the clearance volume and holds the discs 62 forcefully against their seats 59 as the piston 12' retreats in its cylinder 11'. The identical sequence of events occurs in the operation of the intake and exhaust valves associated with the other piston 12, and the reciprocating motion of the piston and rods is translated to continuous rotation of the crankshaft 13, since movement of one piston is 180° out of phase with the other.

The outer ends of the keeper bar 65 can be secured to the head 16 in any suitable manner, such as being held by permanent magnets 75 that are adhered to the head adjacent the exhaust ports. A direct structural attachment of the bar to the head also can be made.

FIGS. 5–8 show schematically various valve configurations in accordance with the present invention. In each example, a valve seat surface 80 surrounds a port 81 through which fluid flow is to be controlled in one direction or the other. In FIG. 5, a valve element 82 is shown as being attracted to a variable restraining means 83. The valve element 82 may be a hinged plate, or can be a floating device readily visualized by one skilled in the art. In all events, the valve element 82 will remain open, as shown, until the closing forces generated by fluid flow, for example to the right in FIG. 5, exceed the forces due to the means 83 that restrains the valve element from closing. Since the restraining forces can be controlled in accordance with a unique aspect of the present invention, they can be set to allow any desired rate of flow to occur before the valve element 82 can close. Since the primary operating energy for closing the valve element 82 is derived from a characteristic of the working medium, namely its velocity in the embodiment shown herein, valve actuation is substantially free of the effects of mass, drag, cam ramp angle limits, and many other conditions which have heretofore slowed down actuation of a valve. Since it is not required to move the valve element against a closing force, but merely to restrain the valve element, the control energy requirement is very small.

FIG. 6 shows another schematic example having a seat 80, a port 81, a valve element 82 and a variable restraining means 83, and further includes a downstream valve element 85 that also is shown as a hinged plate. The function of the valve element 85, which can seat against surface 86, is to permit operation of the valve apparatus at other than the highest pressure in the expansible chamber system.

In FIG. 7, a switch 87 is used to permit the variable restraining means 83 to be disabled. Otherwise this example includes a valve element 82, a port 81 and an unrestrained valve element 85 on the downstream side of the port 81.

The example shown in FIG. 8 includes a port 81, a seat 80, and a valve element 82 that is coupled to a variable restraining means 83 on one side of the port, and another valve element 85 coupled to a variable restraining means 88 on the opposite side thereof. In this generalized example, there can be bi-directional flow at any pressure within the cycle range, with each valve element being closed when the flow of working medium exceeds a predetermined velocity, depending upon the setting of the individual variable restraining means 83 and 88.

Another embodiment of the present invention is shown in FIG. 9. In this example, the port 81 is provided with a tapered seat surface 90, and the valve element is a floating disc 91 having a frusto-conical outer edge 92. In the open position shown in FIG. 9, the valve element 91 is held against the lower surface of the core 93 about which a coil 94 is wound to provide variable restraining forces against closing movement of the valve element. The vertical spacing of the lower end of the core 93 with respect to the conical seat surface 90, and the vertical dimension of the conical edge 92, are such that the valve element 91 can not become laterally displaced to the extent that it will not close against the seat 91 as it moves away from the lower surface 95 of the core 93. As in all previous embodiments, a variable electric current is applied by a source P to the coil 94 via a variable resistance R to vary the restraining forces which tend to prevent valve closing. However, when the flow rate of the working medium through the port 81 generates closing forces which over balance the restraining forces due to magnetic attraction the valve element 91 will snap closed against the seal 90.

In accordance with a further feature of the present invention, the upper shank of the core 93 can be threaded through the support member 96, as shown in FIG. 9, and the outer end of the shank provided with a slot 97 to enable adjustment (by a suitable tool such as a screwdriver) of the gap or amount of vertical separation between the valve disc 91 and the seat surface 90 when the valve element is fully open. Adjustment of the gap will vary the throttling of the valve element 91, and thus the flow velocity of the working medium through the port 81 at which the valve element will close for a given restraining force. Of course other mechanical systems will be readily apparent to those skilled in the art for moving the core 93 axially with respect to the seat 90, and all such systems are intended to be encompassed within the scope of the present invention.

Figure 10:
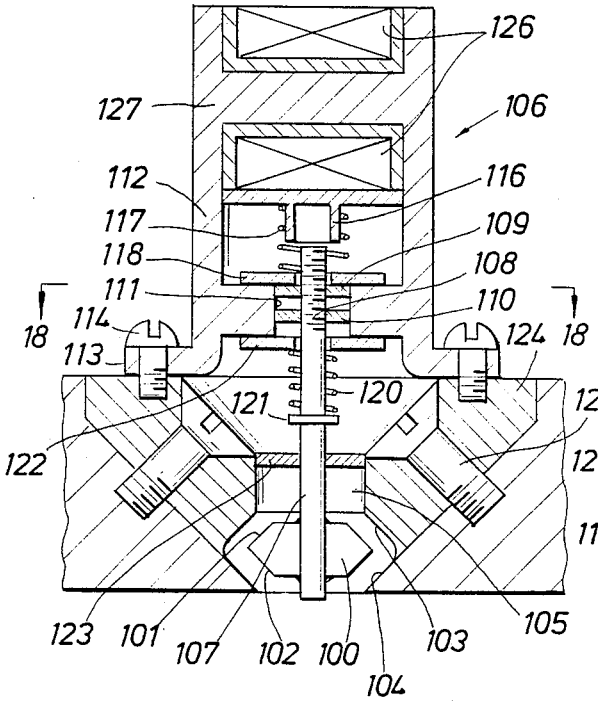
FIGS. 10–14 are cross-sectional views of various valve and controller structures according to the present invention where the valve element is restrained against closing in either direction.

FIG. 10 illustrates in greater detail an embodiment of the present invention having a valve element 100 with upper and lower closure surfaces 101 and 102 that can cooperate with spaced-apart, opposed seat surfaces 103 and 104 to close a flow passage 105 against flow in either direction. The valve element 100 normally occupies the mid-position as shown in the drawing, and is restrained against closing movement in either direction by a variable restraining means indicated generally at 106. The valve element 100 is mounted on the lower end of a stem 107 that has a threaded upper section 108 which receives adjusting nuts 109, 110. The nuts 109, 110 are slidably received in an opening 111 in a guide frame 112 that is mounted by feet 113 and screws 114 to the chamber wall 115. A spring guide 116 receives a coil spring 117 which engages a keeper 118 that rests on an upwardly facing wall surface of the frame 112, and a lower coil spring 120 in compression has its lower end pressing against a flange 121 on the stem 107 and its upper end pressing against a lower keeper 122 that engages a downwardly facing wall surface of the frame 112. Thus, the spring 120 holds keeper 122 against the frame 112 until the nut 110 pushed it off. A spider or web 123 provides alignment of the stem 107 within the passage 105. In a preferred embodiment, the upper seat surface 103 is formed on an insert 124 which defines the passage 105, and which is attached to the wall 115 by screws 125, or the like, as shown in phantom lines in FIG. 10.

The restraining means 106 is a magnetic device including an electric coil 126 that is mounted in cavities in the upper section 127 of the guide frame 112, the coil being connected by suitable conductor wires (not shown) to a controlled source of electric current. The guide frame 112 and the keepers 118, 122 are made of a material having low magnetic reluctance and together form a magnetic circuit that is influenced by the amount of current flowing in the coil 126. A fluid flowing through the passage 105, for example, in the upward direction will tend to cause upward movement of the valve element 100 and its stem 107 toward the upper closed position, such movement being yieldably opposed by the springs 117, 120 with a force that is a function of the stiffnesses of the springs, and by a variable force resisting upward movement of the keeper 118 which rests on the upper adjustable nut 109. Downward movement of the valve element 100 from its mid-position to its closed position against the lower seat surface 104 is opposed by the restraining force on the lower keeper 122 which comes into play after the adjusting nut 110 moves into engagement with the keeper 122. If desired, a coil spring (not shown) can be mounted on the stem to react between the flange 121 and the spider 123 so that the total restraining force includes a mechanical component that depends upon the stiffness of such additional spring.

Figure 11:
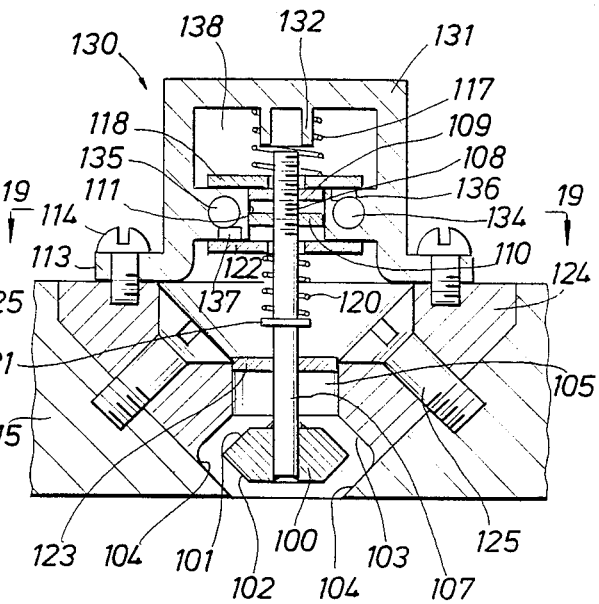

FIG. 11 shows a similar valve arrangement to that shown in FIG. 10, but with a different restraining means indicated generally at 130. To the extent possible, identical components are given the same reference numerals for convenience of illustration and to simplify the description. In this embodiment, the restraining means 130 includes a frame 131 that includes a spring guide 132 which receives the upper end of the upper spring 117. The mid-section 133 of the frame 131 is provided with pressure ports 134, 135, the port 134 being in communication with an arcuate recess 136 which underlies a substantial portion of the lower surface of the upper keeper 118, the other port 135 being in communication with an arcuate recess 137 which overlies a substantial portion of the upper surface of the lower keeper 122. The respective ports 134, 135 are connected to sources of controlled fluid pressure that are described below with reference to FIG. 20. Generally, the system includes a line to feed pressure to a port 134 or 135 from an accumulator volume that is much larger than the sum of the volumes of the feeder tube, passage 134 or 135 and cavity 136 or 137. The accumulator is connected by an adjustable pressure regulator valve to a lower pressure region such as atmosphere, or a vacuum pump. The regulator valve includes an operator such as a diaphragm with one side subject to accumulator pressure, and the other side subject via a pilot line to the cavity 138 around the valve element being controlled. Thus the restraining force generated by the difference in pressure between cavity pressure and the pressure in the arcuate recess 136 or 137 resists upward movement of the upper keeper 118, and downward movement of the lower keeper 122. The relatively large volume of the accumulator, which is at controlled pressure, provides a system whereby when a keeper has moved away from the recess, system pressures are not materially affected, and a controlled restraining force is obtained.

As in the embodiment shown in FIG. 10, the valve element 100 normally occupies its middle, open position. A fluid flowing upward through the passage 105 past the element 100 will tend to shift the element and the stem 107 upward to bring the valve surface 101 against the seat 103. Such upward movement is restrained, however, by the springs 120, 117, and the downward force on the upper keeper 118 due to the greater pressure in the cavity 138 than in the recess 136. The total restraining force is variable through control of the difference in pressures between cavity pressure and recess pressure.

Should flow be in the downward direction through passage 105, movement of the valve element 100 against the seat 104 is restrained by the spring 120 which is in compression, and the upward force on the keeper 122 due to pressure difference with respect to the recess 137, in the manner described above. Hereagain, a controlled restraining force is achieved.

Figure 12:
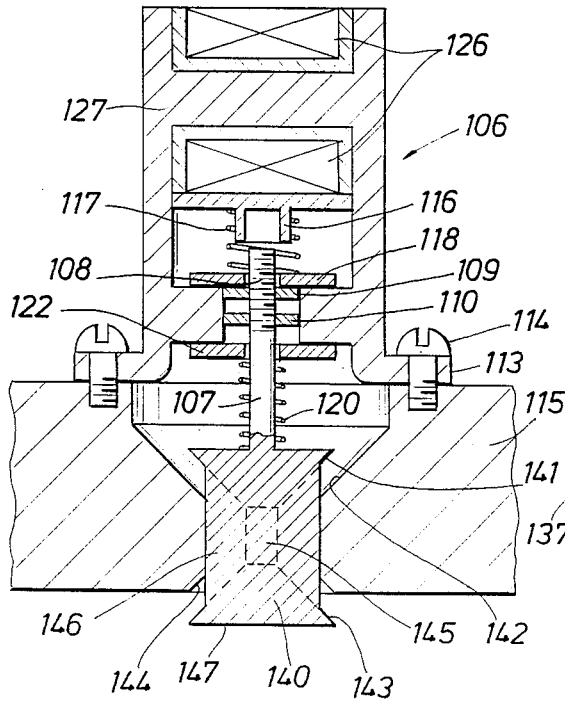

FIG. 12 illustrates an embodiment having a variable restraining means 106 as described above respecting FIG. 10, but with a valve element 140 in the general shape of a spool attached to the lower end of the stem 107. The spring 120 reacts between the lower face of the lower keeper 122 and the upper face of the element 140. The element 140 has an upper, inclined closure surface 141 that can seat downward against a companion seat surface 142 on the wall 115, and a lower inclined surface 143 that can seat upwardly against a companion seat surface 144. The valve element 140 has a smaller dimension central section 145, and a plurality of outwardly extending ribs 146. The vertical dimension of the valve element 140 is elongated such that the lower surface 147 extends beyond the lower surface 148 of the chamber wall 115.

In the mid-position shown in FIG. 12, fluid can flow upwardly past the surfaces 141 and 143 and through the open regions past the ribs 146. Engagement of the lower surface 147 by a piston (not shown) nearing top dead center will force the valve element closed against the seat 144. Alternatively, upward movement of the valve element 140 due to flow is yieldably resisted by the combined actions of the springs 120 and 117, and a variable restraining force that resists upward movement of the keeper 118, which, as previously described, forms a part of a magnetic circuit which is energized by current in the coil 126. Thus the closing of the valve element can be very precisely controlled to occur at a specified flow rate. Downward movement of the valve element 140 in response to downward flow is restrained by the lower keeper 122 once engaged by the adjusting nut 110.

Figure 13:
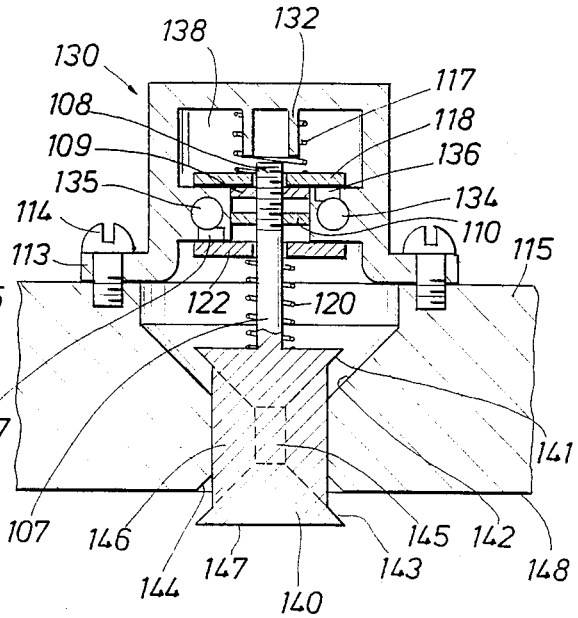

FIG. 13 shows an embodiment of the present invention that includes the combination of a pneumatic restraining force controller 130 as described above respecting FIG. 11, and a spool valve arrangement 140 as described above respecting FIG. 12.

Figure 14:
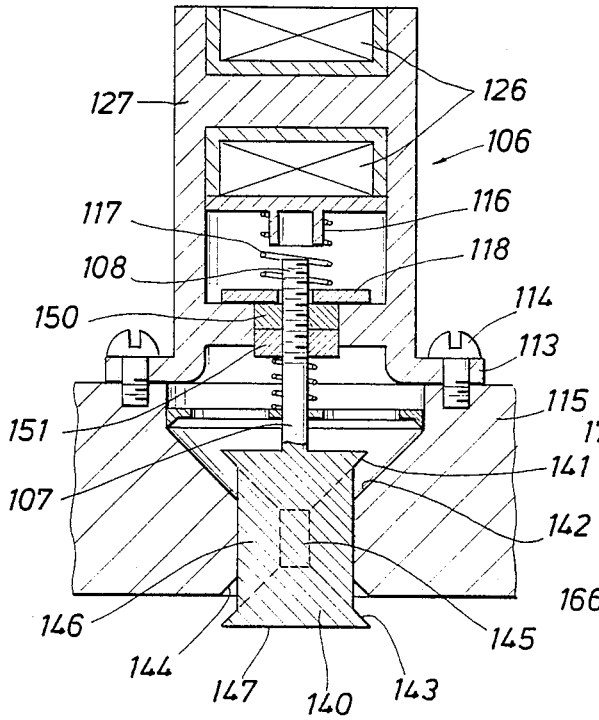

FIG. 14 illustrates an embodiment of the present invention that is similar to that shown in FIG. 12, except the lower keeper is deleted, and the upper and lower nuts 150 and 151 are locked together by tightening. The spring 120, although shown, is only necessary if the valve element 140 must rest away from the seat 144 in the no flow condition, as may be a requirement for start-up, or other transient conditions. In the absence of a greater pressure above the valve element 140, a low flow rate will shift the valve and stem upward to the position shown, whereupon a restraining force, controlled by current in the coil 126, is applied to control the closing in the upward direction to occur at a certain flow rate. Hereagain the valve element 140 is designed to be closed in response to piston position, for use in certain applications.

Figure 15:
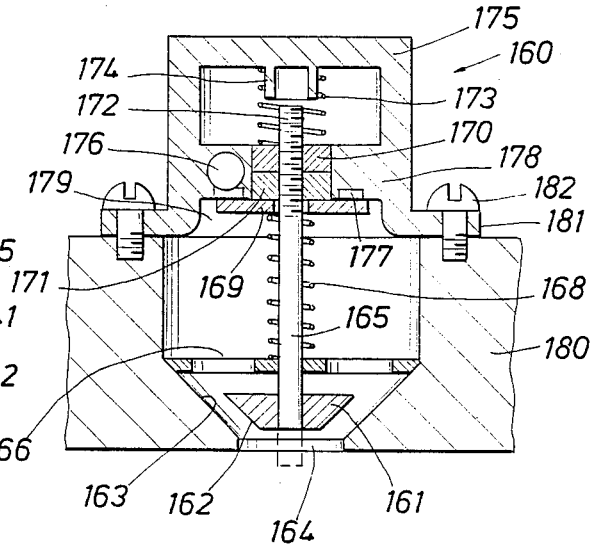
FIGS. 15–17 are cross-sectional views of additional embodiments of the present invention where the valve element is restrained against closing in one direction.

FIG. 15 shows an embodiment of the present invention including a pneumatically controlled restraining device 160, and a valve element 161 that is restrained against closing in the downward direction. The element 161 has an inclined closure surface 162 that can engage a companion seat surface 163 through which the flow port 164 extends. The valve stem 165 passes through a spider or web 166 which guides the same, and has an outwardly directed flange 167 that engages the lower end of a coil spring 168. The upper end of the spring 168 engages a keeper 169. Adjusting nuts 170, 171 that are threaded onto the upper section 172 of the stem 165 are locked together by tightening, and an upper coil spring 173 that engages the upper nut 170 is mounted on a spring guide 174 on the guide frame 175. A control pressure port 176 communicates with an arcuate recess 177 formed in the lower face of the mid-section 178 of the guide frame 175, so that a greater pressure in the cavity 179 below the keeper 169 tends to hold the keeper against the mid-section 178 to thereby prevent downward movement of the stem 165 due to engagement of the lower nut 171 with the keeper. As in previous embodiments, the guide frame 175 is secured to the chamber wall 180 by legs 181 and screws 182.

The valve element 161 will remain open, as shown, to flow in the downward direction at low rates, but will move downward to closed position when downward force thereon due to a greater flow rate over balances the upward restraining force due to pressure differential across the keeper 169. Since the restraining force is a controlled variable, the valve element 161 can be permitted to close at a selected flow rate. If desired, the valve stem 165 can have its lower end extended through the port 164 as shown in dashed lines to a level below the lower surface of the wall 180 so as to be automatically reopened by engagement with a piston near top dead center.

Figure 16:
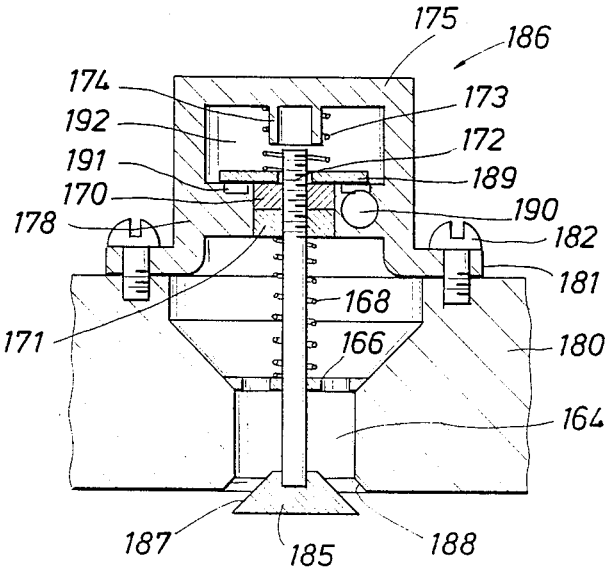

FIG. 16 illustrates an embodiment that is similar in overall construction to the embodiment shown in FIG. 15, except that the valve element 185 is arranged to close in the upward direction, and the controller 186 provides a variable restraining force in the downward direction. In this instance, the upper closure surface 187 is inclined as shown, and is arranged to move against a companion seat 188 to close off flow through the port 164. The coil spring 168, which is required only if the valve element must rest away from the seat under a transient condition such as start-up, engages the lower guide nut 171, and a keeper 189 is pressed downward against the top surface of the frame mid-section 178 by a coil spring 173 that is received on a spring guide 174. A control pressure port 190 communicates with an arcuate recess 191 in the upper surface of the section 178, whereby a greater pressure in the frame cavity 192 will tend to hold the keeper 189 down against the section 178 and the nut 170. Thus closing movement of the valve element 185 is resisted or aided by the net force of the springs 168 and 173, and resisted by a variable force due to pressure differential across the keeper washer 189. Hereagain, the provision of a variable, controlled force in series with the mechanical force of the springs 168 and 173, provides an arrangement where closing of the valve element 185 can be set to occur at a precise flow rate in the upward direction through the port 164.

Figure 17:
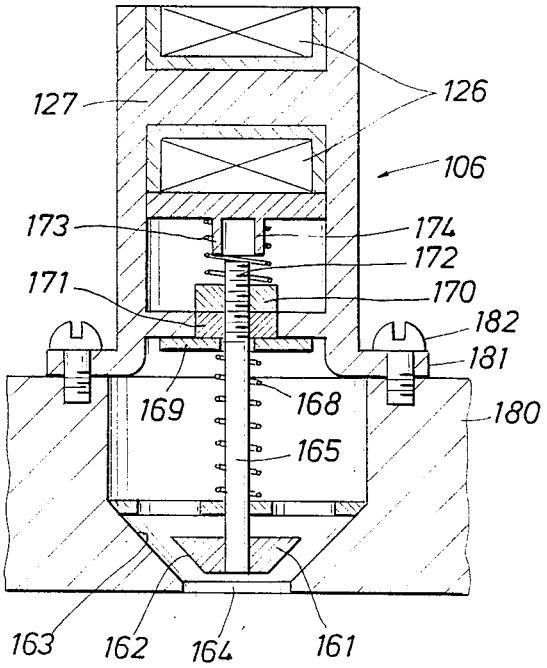

FIG. 17 illustrates the combination of a magnetically controlled restraining device 106, and a normally open valve element 161 that closes in the downward direction at a predetermined rate of flow as described above respecting FIG. 16. In this embodiment, the lower spring 168 reacts between the flange 167 and a keeper washer 169 located below the adjusting nuts 170, 171, with the upper spring 173 being positioned against the upper nut 170. The keeper washer 169 forms a part of a magnetic circuit when the coil 126 is energized by electric current, and the valve element 161 is biased open or closed by the net force of the upper springs 168 and 173. The electric current is adjusted such that the valve element 161 will remain open at low flow rates. However when a sufficient magnitude of downward force is applied to the valve element 161 by an increased rate of flow through the port 164, the restraining force is overcome, and the valve element 161 moves downward to its closed position.

Although the various embodiments shown in FIGS. 10–17 can control flow through a cylindrical port, there being ample flow spaces between the circumferentially spaced legs 113 or 181, a plurality of controllers can be arranged at spaced locations and connected to an elongated valve element which controls flow through an elongated port to provide a significantly increased flow area. For example as shown in FIG. 18, which is a cross-section of such an embodiment on lines 18—18 in FIG. 10, three magnetic controllers **106*a*, 106*b* and 106*c* are mounted on the insert 124 by means of the screws 114. The stem 107 of each controller is connected to a single elongated valve element 100*a* having the same vertical cross-section as shown in FIG. 10. The valve seat, of course, is correspondingly elongated to provide a large flow area through the chamber wall 115. As shown in FIG. 18, the housing 112 of the guide frame can be a single piece construction, with separate cavities for the coils 26 located generally above each valve stem 107**, or with a single coil servicing all three valve stems.

FIG. 19 is in a view similar to FIG. 18, but taken on lines 19—19 of FIG. 11, where an elongated valve and seat arrangement is employed. The guide frame **131*a* is a generally rectangular structure having the control pressure passages 134 and 135 formed therein. The passage 135 communicates with each of the arcuate lower recesses 137 which are shown in phantom lines, and a suitable connection (not shown) is provided at the open end of the passage 135 for communicating an externally controlled pressure to each recess. The arrangement of valve stems 107, valve element 100*a* and elongated valve seat is the same as that shown in FIG. 18**.

FIG. 20 is a schematic view of a pneumatic control system that provides a restraining force to a valve in accordance with the present invention. Such system was discussed in functional terms above, and the various structural components now will be described. The reference number 200 indicates the parts of the valve that enable the restraining force to be applied, for example the keeper washer 169 and the arcuate recess 177 shown in FIG. 15, and the reference numeral 201 indicates the cavity 179 below such washer. The passage 176 which communicates with the recess 177 is connected to a line 203 that leads to an accumulator 204 that has a volume that is much greater than the volume of the cavity 179. The cavity 179 is communicated by a line 205 to a region 206 above the diaphragm 207 of a regulator valve 208 having an element 209 that can close against a seat 210. The region 211 below the diaphragm 207 is connected by a line 212 to the accumulator volume 204, whereby the cavity pressure P-1 tends to close the valve element 209, and the accumulator pressure P-2 tends to open the valve. The outlet of the regulator valve 208 leads to a low pressure source 213, which might be atmospheric pressure in some applications, and a vacuum pump in others. Thus the pressure P-2 in the large volume 204 can be controlled such that when the keeper washer 169 is off its seat, the pressure in the accumulator is not materially affected, and remains substantially constant. Thus a holding or restraining force is generated that is related to the difference in the pressures P-1 and P-2 and the transverse cross-sectional area of the recess 177, and which can be adjusted by adjustment of the tension in a spring 214 below the diaphragm 207, either manually by a handle 215 or automatically by suitable means (not shown). In any event a variable restraining force is applied in the upward direction on the keeper washer 179, and the valve stem 165 via the nut 171, which prevents the valve element 161 from closing until a predetermined flow rate is present. The same controller system described above can be used with any of the other valve systems shown in FIGS. 11, 13 or 16 to provide a variable restraining force in accordance with the concepts of the present invention.

Figure 21:
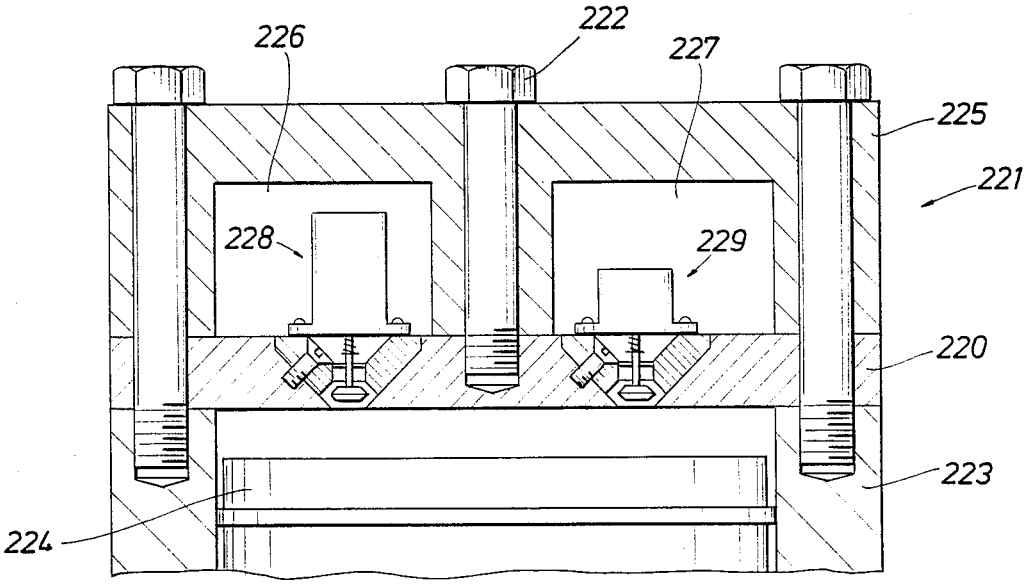

FIG. 21 shows valves of the type shown in FIGS. 10 and 11 mounted on the head 220 of an expansible chamber motor 221. The head 220 is bolted by elements 222 to the cylinder 223 which has a piston 224 movable reciprocably therein. The elements 222 also mount a manifold 225 on the head 220, such manifold having a high pressure chamber 226 and a low pressure chamber 227. The manifold 225 has a working medium inlet into the chamber 226, and an exhaust outlet from the chamber 227, which are not shown, but which are the same as shown in FIG. 1A. The inlet valve element 228 is that device shown in FIG. 10 and described above, and the exhaust valve element 229 is that structure shown in FIG. 11 as described above.

Figure 22:
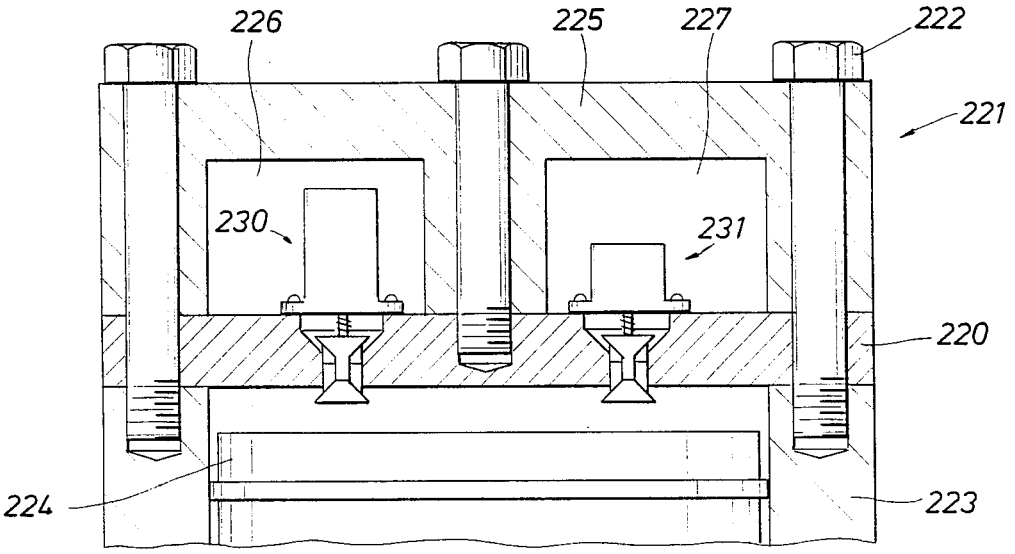

FIG. 22 is a cross-section similar to FIG. 21, whereby identical parts have been given the same reference numbers, however the intake valve 230 is that valve shown in FIG. 12 and the exhaust valve 231 is that valve shown in FIG. 13. In each cause, where the restraining device involves magnetically generated holding forces, a control system of the type shown in FIGS. 5–9 can be employed. Where the restraining device includes a differential pressure acting across a keeper washer as shown in FIGS. 11, 13, 15 and 16, a control system of the type shown in FIG. 20 can be employed.

OPERATION

In operation, the engine 9 is assembled as shown in the drawings and the line 25 hooked up to a source of an expansible medium under pressure, such as a boiler that produces steam. With no pressures other than ambient being present in the cylinders 11 and 11', the plenum chamber 22 and the exhaust section of the manifold 20, all intake valves 32 and 32' are initially closed, as are the outer exhaust valve discs 64. One method of starting the engine is by using an external device such as an automotive-type starter with wet cell battery power. A charge of working medium will flow into the other cylinder via its open intake ports 30 and force that piston rearward.

At a controlled flow rate or velocity of working medium through the intake ports 30, the reed valves 32 snap closed to provide cut-off. As one piston retreats, the other piston advances. The exhaust valve spring 68 keeps the valve disc 62 open until the advancing piston reaches very near top-dead-center, at which point the intake valves 32 are opened by the lifters 41, and the exhaust valve 62 is closed by engagement with the top of the piston. A charge of working medium thus enters that cylinder via its open intake ports and forces the piston rearward, with cut off as described above.

When the other piston reaches bottom-dead-center, the working medium pressure will have been reduced to the extent that the spring 68 will force the inner valve disc 62 off its seat 59. Then as that piston advances, spent working medium in its cylinder will be exhausted via the passages 57 until the disc 62 is closed by engagement with the top of the piston. Then the cycles repeat in each cylinder.

The piston speed and power output of the engine 9 can be varied by changing the current applied through the electromagnetic coils 50 to increase or decrease the restraining forces on the reed valves 32, thereby increasing or decreasing the amount or mass of working medium that will enter the cylinders for any given boiler pressure.

It will be recognized that communication between chambers that contain significant volumes of expansible working medium which are at significantly different pressures will result in a loss of available energy. The intake valves 32 and 32' of the present invention open only when the clearance volume of the cylinders is insignificant, and the exhaust valves 62 open only when cylinder pressures and ambient pressures are nearly matched. Thus the present invention operates at high efficiency due to the unique nature of the valve designs. As opposed to prior systems having camshafts and gearing, it is the stream of working medium flow that provides the actuating energy to close the intake valves, and such actuation is automatic at a given flow rate or velocity. The exhaust valves are opened automatically by the pressure of a compressed coil spring when cylinder pressure drops to a value near ambient. Of course, the flywheel 14 stores kinetic energy at the end of a cycle that is carried over to the next cycle.

The valves disclosed herein have minimum mass and low inertia, and thus are opened and closed with minimum stresses. Impact stresses can be further reduced if desired by employing elastomer lifters and pads, which are resilient to provide yielding impact.

Although the intake valve discs for the intake ports to each cylinder are described herein as being joined by a web, it is within the scope of the present invention to provide separate valve elements through elimination of the webs. In this case, the first and second coils, and the third and fourth coils could be wired separately in series, and different currents applied with respect to individual cylinders. It also is within the scope of this invention to use hinged valve plates, or floating valve elements that are guided with respect to the seat.

The present invention has a wide variety of uses, whenever efficient motive power is needed. Although the present invention has been described in connection with an engine, power could be input to the crankshaft and the machine operated as a compressor or pump. It also will be recognized that the intake valve structure per se, together with the controllable restraining system as disclosed herein, can have a wide variety of uses in controlling fluid flow, whether a liquid, a gas or a mixture of gases and liquids.

A determination of when sufficient flow of working medium has occurred, so that the restraining force of a valve element is reduced to enable it to close, can be made through feedback, precomputation, real-time modeling, and the like. The restraining force is considered as being reduced when its net value is below that required to maintain it open against the force due to fluid flow therepast. Such restraining force can be set at a magnitude that will be exceeded by the fluid force when an instantaneous flow rate is reached, or reduced to a magnitude that is less than the fluid force when a certain instantaneous flow rate is achieved. Reopening of the check valve can be accomplished in response to a reversal of relative system pressures acting thereon, or by way of direct or indirect action of a movable wall of the exhausting chamber when that chamber volume approaches a minimum.

If pressures in the system do not reverse cyclically, the cycle can nevertheless be achieved where one of the following occurs: (1) pressures come very near to reversal, so that the spring bias on the check valve can cause it to change positions, and where closeness of pressures prevents excessive P-V energy losses, and (2) the volume of expansible fluid in one of the chambers is negligible when pressure reversal is desired, so that pressure equalization can be induced by forcing the valve open mechanically, as disclosed herein, without excessive P-V loss, and the valve spring bias can sustain the valve in a desired position between the substantially equalized pressures.

Since certain changes or modifications may be made in the disclosed embodiments without departing from the inventive concepts involved, it is the aim of the appended claims to cover all such changes and modifications falling within the true spirit and scope of the present invention.

What is claimed is:

1. An expansible chamber apparatus comprising: piston and cylinder means; a head defining the outer end of said cylinder means and having an intake port; an intake valve seat surrounding said port on the outer side of said head; intake valve means arranged to move into engagement with said seat to close said intake port when the velocity of flow of a working medium into said cylinder means through said intake port exceeds a controllable value; and means for applying a variable restraining force to said intake valve means that tends to prevent closing movement thereof, whereby the particular value of flow velocity at which said intake valve closes can be selected.

2. The apparatus of claim 1 wherein said intake valve means comprises a thin metal plate mounted for movement toward said seat in order to close said intake port and away from said seat to open said intake port, said valve means being subject to inwardly directed force due to working medium flowing into said cylinder means via said port.

3. The apparatus of claim 2 wherein said plate is attached to said head by a resilient leg that is shaped in a manner to bias said plate toward said intake port.

4. The apparatus of claim 1 further including means on said piston means arranged to engage said intake valve means when said piston means is at substantially top-dead-center for moving said intake valve means off said seat to thereby enable said intake valve means to reach its open position.

5. The apparatus of claim 4 wherein said lifting means comprises an element secured to said piston means and arranged to enter said intake port as said piston means nears top-dead-center.

6. The apparatus of claim 1 wherein said restraining means includes an electromagnetic element for creating a magnet field that influences the closing of said intake valve means when said element is subjected to an electric current; and means for supplying variable electric current to said electromagnetic element.

7. The apparatus of claim 6 wherein said supplying means includes power supply means, means for varying the output of said power supply means; and sensor means responsive to an external condition for controlling said varying means.

8. The apparatus of claim 1 further including exhaust port means in said head; seat means on an inner surface of said head surrounding said port means; and pressure responsive exhaust valve means engageable with said seat means to prevent escape of said working medium during expansion of said chamber.

9. The apparatus of claim 8 further including spring means for opening said exhaust valve means when the pressure in said cylinder has dropped to a certain value with respect to ambient pressure.

10. The apparatus of claim 9 further including surface means on said piston means engageable with said exhaust valve means for moving same against said seat means when said piston means nears top-dead-center.

11. The apparatus of claim 8 further including magnetic means fixed with respect to said exhaust valve means and arranged to apply a repulsion force that moves said exhaust valve means against said seat means when said piston means nears top-dead-center.

12. The apparatus of claim 11 wherein said exhaust valve means includes a second seat means surrounding said port means on the outer side of said head; inwardly closing check valve means engageable with said second seat means for preventing inward flow, said spring means biasing said check valve means toward said second seat means; and actuator means extending through said head for moving said check valve means away from said second seat means in response to engagement of said piston means with said exhaust valve means.

13. An expansible chamber apparatus comprising: a piston movable inwardly and outwardly in a cylinder; a crank shaft; means for translating said inward and outward movement to rotary motion of said crank shaft; said cylinder having a head closing the outer end thereof, said head having an intake valve section and an exhaust valve section; an intake port extending through said intake section; a seat surrounding said intake port on an outer surface of said head; an intake valve element mounted for movement relative to said seat for admitting an expansible working medium at high pressure into said cylinder; plenum means attached to said head and covering said intake valve section, said plenum means having a fitting adapted to be connected to a source of pressurized working medium; variable means for restraining movement of said intake valve element toward said seat; said intake valve element being shaped in a manner such that flow of working medium from said plenum through said intake port forces said valve element toward said seat, whereby said valve element will close against said seat only when the flow rate of said medium is of sufficient magnitude to overbalance said restraining means.

14. The apparatus of claim 13 wherein said valve element has a pressure responsive transverse area on which the pressure of working medium in said plenum can act to hold said valve element closed against said seat as cylinder pressure is reduced during expansion of said medium therein.

15. The apparatus of claim 14 further including means responsive to the position of said piston for opening said intake valve means when said piston nears top-dead-center.

16. The apparatus of claim 15 wherein said opening means comprises an elongated element on said piston arranged to extend through said intake port and engage said valve element to shift said valve element away from said seat.

17. The apparatus of claim 13 wherein said valve element comprises a thin metallic disc having low mass.

18. The apparatus of claim 17 wherever said restraining means includes an electromagnetic element mounted adjacent said disc and responsive to electric current for applying restraining force to said disc.

19. The apparatus of claim 18 wherein said electromagnetic element comprises a coil; means for mounting said coil on said plenum; and conductor means extending from said coil to a location externally of said plenum where said conductor means can be connected to a source of variable electric current.

20. The apparatus of claim 13 wherein said exhaust valve section has exhaust port means extending therethrough, and first seat means surrounding said exhaust port means on an inner surface of said head.

21. The apparatus of claim 20 further including an exhaust valve element engageable with said first seat means during expansion of said medium for preventing escape of said medium from said cylinder; and spring means for moving said exhaust valve element away from said seat means when expansion of said medium has reduced its pressure to a predetermined level relative to exhaust manifold pressure.

22. The apparatus of claim 21 wherein said exhaust valve element comprises a disc element; and elastomer means on an inner surface of said disc element adapted to be engaged by said piston near top-dead-center for forcing said disc element against said first seat means.

23. The apparatus of claim 22 wherein said disc element has a transverse pressure area responsive to the pressure of said working medium entering said intake port for holding said disc element against said first seat means during substantially all of the expansion phase of said medium.

24. The apparatus of claim 23 further including second seat means surrounding said exhaust port means on an outer surface of said head; and check valve means associated with said exhaust valve element for permitting outward flow of spent working medium via said exhaust port means but preventing any inward flow therethrough.

25. The apparatus of claim 24 further including a stem for coupling said exhaust valve element and said check valve to one another.

26. The apparatus of claim 25 further including a stop mounted on said head on the outer side thereof, said spring means reacting between said stop and said check valve means, said stem transmitting opening force to said exhaust valve element.

27. The apparatus of claim 25 further including exhaust manifold means covering said exhaust valve section for directing spent working medium to a location away from said cylinder.

* * * * *